United States Patent [19]

Vogel

[11] 4,035,609

[45] July 12, 1977

[54] ELECTRIC HEATING ELEMENT ASSEMBLY WITH SOLDERLESS BULKHEAD FITTING AND METHOD OF ASSEMBLY

[75] Inventor: Alan D. Vogel, Laurel, Md.

[73] Assignee: Electro-Therm, Inc., Laurel, Md.

[21] Appl. No.: 564,938

[22] Filed: Apr. 3, 1975

[51] Int. Cl.[2] ..... H05B 1/00; F24H 1/00

[52] U.S. Cl. ..... 219/335; 29/505; 29/520; 29/611; 219/336

[58] Field of Search ..... 219/335, 336, 523, 316, 219/318; 29/505, 517, 520, 515, 610, 611

[56] References Cited

U.S. PATENT DOCUMENTS

| | | | |
|---|---|---|---|
| 2,785,270 | 3/1957 | Burger | 219/336 X |
| 3,116,401 | 12/1963 | Drugmand | 219/336 X |
| 3,354,294 | 11/1967 | Kollar et al. | 219/336 X |

*Primary Examiner*—C. L. Albritton

*Attorney, Agent, or Firm*—Henry W. Collins; Paul C. Flattery; Richard G. Kinney

[57] ABSTRACT

An electric heating element assembly includes a solderless fitting for sealably securing a sheathed heating element through an aperture in a container wall or bulkhead, such as in a dishwasher or the like. The fitting includes a cylindrical sleeve positioned over the sheath of the heating element and through the aperture. A radial flange on the fitting is drawn tight against a gasket and the wall by means of a fastener on the outside surface of the sleeve to secure a watertight seal between the fitting and the wall. The sleeve is attached to the sheath by means of an annular lip on the face of the flange, circumferential portions of this lip being axially compressed during assembly so as to radially-inwardly deform corresponding circumferential portions of the sleeve and the sheath to obtain a rotationally-locked liquid-sealing engagement therebetween.

18 Claims, 8 Drawing Figures

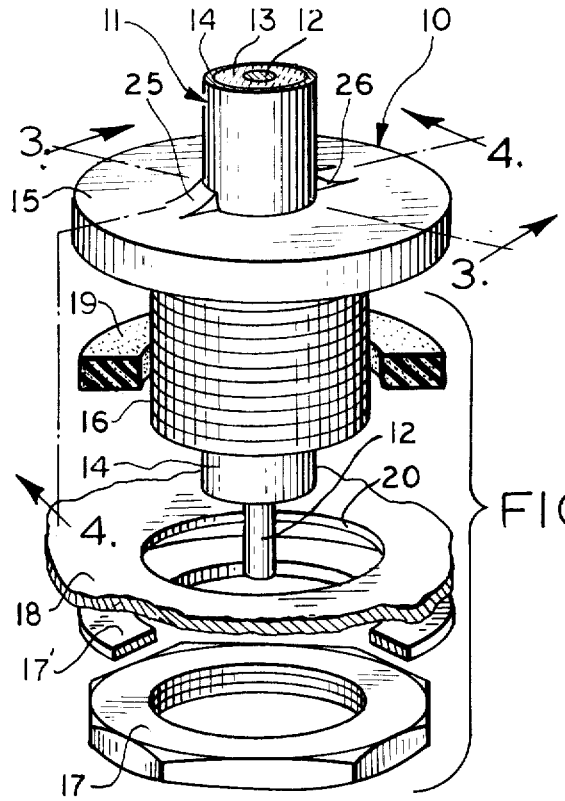
FIG. 1
FIG. 4
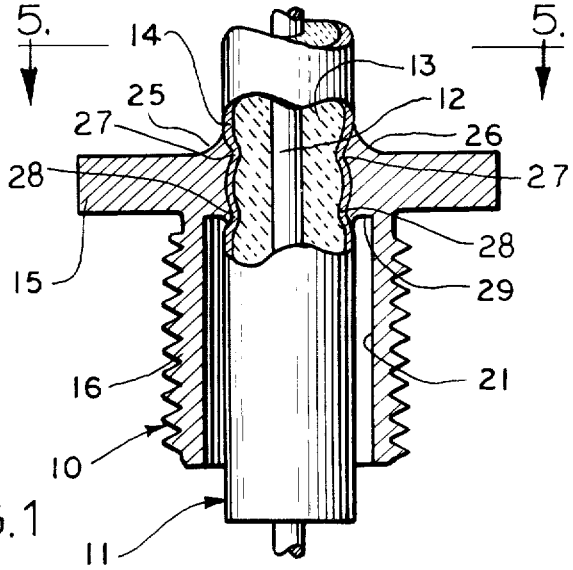
FIG. 3
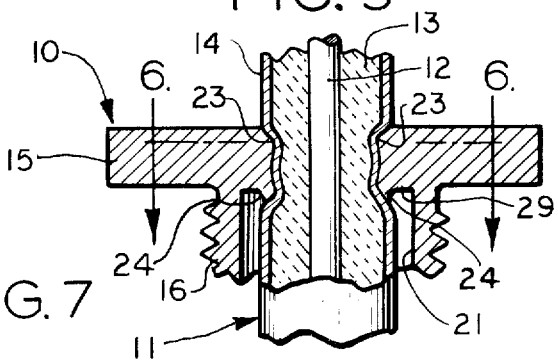
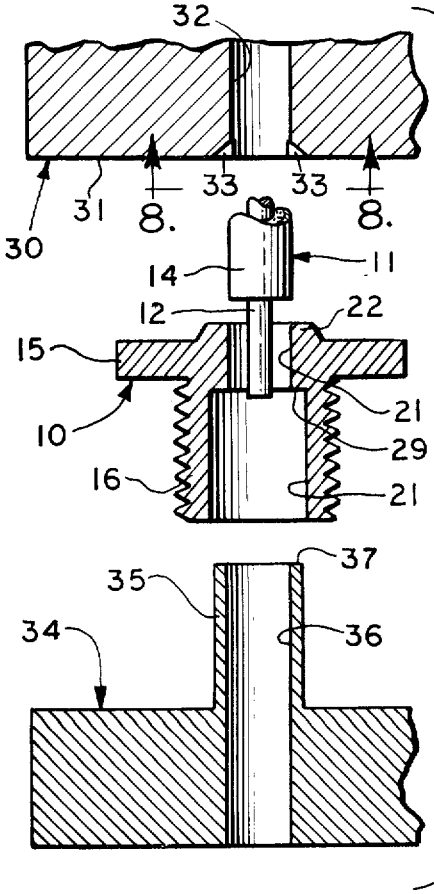
FIG. 7
FIG. 2
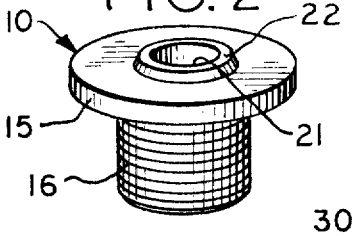
FIG. 8
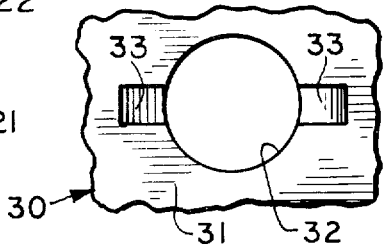
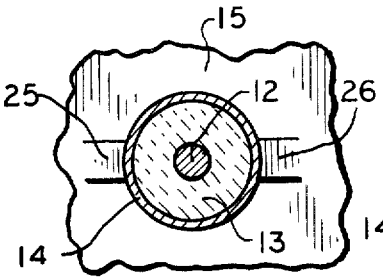
FIG. 5
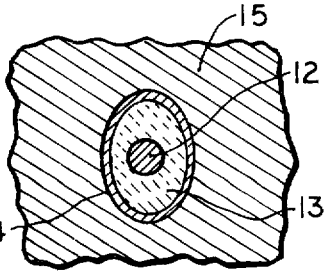
FIG. 6

ELECTRIC HEATING ELEMENT ASSEMBLY WITH SOLDERLESS BULKHEAD FITTING AND METHOD OF ASSEMBLY

BACKGROUND OF THE INVENTION

This invention relates generally to electric heating element assemblies, and particularly to bushings or fittings for sheathed electrical conductors, and more particularly to a solderless fitting and method for establishing a mechanically-rigid liquid-tight seal between the sheath of an electrical rod-type heating element and the wall of a container.

Electrical rod-type heating elements of the type commonly used in water heaters, stoves, and other appliances generally consist of a resistance wire or conductor surrounded by a concentric heat-conductive electrically-insulating material, such as magnesium oxide, and an outer electrically-conductive metal sheath. The sheath, which serves to provide a desired shape to the heating element and to protect the insulating material and resistance wire from damage, may be formed of a malleable metal and grounded to protect against electrical shock. The use of such electrical heating elements in automatic dishwashers and other closed liquid systems necessitates that the heating element pass through the wall of a liquid container in order to be supplied with electrical power. This creates the need for a mechanically-rigid, liquid-tight and electrically conductive fitting between the sheath and the container wall which can preferably be installed on the sheath without the need for time-consuming soldering, brazing, or welding operations, and without damaging the sheath or the resistance wire, the insulation, or the electrical conductor container therein.

One difficulty encountered in prior-art solderless fittings for mounting sheathed heating elements was that the fittings tended to loosen from the sheaths as they were tightened, particularly after the fittings had been loosened and tightened several times. The resulting rotation between the sheaths and the fittings had the effect of destroying the liquid sealing capability of the fittings and making further tightening or loosening of the fittings difficult.

SUMMARY OF THE INVENTION

The invention is directed to an electric heating element assembly for mounting through an aperture in a bulkhead. The assembly comprises a sheathed electrical heating element, a fitting including a radial flange portion having a diameter greater than the bulkhead aperture, a sleeve portion integrally adjacent and concentric with the flange portion and having an outer diameter smaller than the bulkhead aperture and a length greater than the thickness of the bulkhead, fastener receiving means on the sleeve portion for engaging a fastener for drawing the flange portion into engagement with the bulkhead, the flange and sleeve portions including an axially-extending aperture through which the sheathed heating element is extended, and the wall of the axially-extending aperture being deformed to decrease the cross-sectional area of at least a portion of the aperture so as to establish a solderless mechanically-rigid liquid-seal with the sheath of the heating element.

The invention is further directed to a fitting for securing a sheathed electric heating element through an aperture in a bulkhead. The fitting comprises a radial flange portion having a diameter greater than the bulkhead aperture, a sleeve portion integrally adjacent and concentric with the flange portion and having an outer diameter smaller than the bulkhead aperture and a length greater than the thickness of the bulkhead, fastener receiving means on the sleeve portion for engaging a fastener for drawing the flange portion into engagement with the bulkhead, the flange and sleeve portions including an axially-extending aperture dimensioned to slidably receive the sheath of the heating element, and lip means on the surface of the flange portion for deforming the wall of the axially-extending aperture in response to an externally-applied compressive force to decrease the cross-sectional area of at least a portion of the aperture so as to establish a solderless mechanically-rigid liquid-seal with the sheath.

The invention is further directed to a method of securing a fitting to a sheathed electrical conductor, the fitting being of the type which sealably passes the conductor through an aperture in a bulkhead and includes a flange portion having a diameter greater than the bulkhead aperture, a sleeve portion integrally adjacent and concentric with the flange portion having an outer diameter smaller than the bulkhead aperture and a length greater than the thickness of the bulkhead, and a threaded portion for receiving a fastener for drawing the flange portion into engagement with the bulkhead, the flange and sleeve portions including a axially-extending aperture dimensioned to slidably receive in surface contact the sheath of the conductor, and a lip on the face of the flange portion adjacent to the axially-extending aperture. The method includes the steps of inserting the sheathed electrical conductor through the axially-extending aperture so as to bring the sheath into surface-contact with the wall of the axially-extending aperture, and axially compressing the lip into the face of the flange portion so as to force the wall of the axially-extending aperture and the sheath to be radially deformed whereby a mechanically-rigid liquid-sealing engagement is established between the fitting and the sheath.

BRIEF DESCRIPTION OF THE DRAWINGS

The features of the present invention, which are believed to be novel, are set forth with particularity in the appended claims. The invention, together with the further advantages thereof, can best be understood by reference to the following description taken in connection with the accompanying drawings, in the several figures of which like reference numerals identify like elements, and in which:

FIG. 1 is a perspective exploded view, with parts shown in section and broken away, illustrating the installation into a bulkhead of an electric heating element assembly and fitting constructed in accordance with the principles of the present invention;

FIG. 2 is a perspective view of the fitting prior to being secured to the sheathed heating element;

FIG. 3 is a partial cross-sectional view of the fitting and a partial cross-sectional view of the sheathed heating element taken along line 3—3 of FIG. 1;

FIG. 4 is a cross-sectional view of the fitting and a partial cross-sectional view of the heating element taken along line 4—4 of FIG. 1;

FIG. 5 is a cross-sectional view taken along line 5—5 of FIG. 4;

FIG. 6 is a cross-sectional view taken along line 6—6 of FIG. 3;

FIG. 7 is a exploded assembly view taken partially in cross section showing the use of opposing die members for assembling the fitting onto the heating element sheath; and FIG. 8 is a plan view taken along line 8—8 of FIG. 7.

DESCRIPTION OF THE PREFERRED EMBODIMENT

Referring to the figures, and particularly to FIG. 1, a heating element assembly constructed in accordance with the principles of the invention includes a bushing or fitting 10 fixedly secured near one end of a conventional rod-type or sheath-type heating element 11, which may include a central terminal lead 12 or cold pin for establishing in electrical contact with its resistance wire, a heat-conductive electrically-insulating material 13 and a metallic outer sheath 14. Fitting 10, which is preferably formed from a semi-malleable metal such as brass, steel, or aluminum, includes an annular flange portion 15 and an adjoining sleeve portion 16, at least a portion of which is threaded to receive a conventional electrically conductive flat washer 17' and a conventional hex nut 17 or other suitable fastening means. When installed in a bulkhead or wall 18 the sleeve portion 16 of fitting 10 is passed through an appropriately sized aperture 20 in the bulkhead and hex nut 17 is turned onto the threaded portion of the sleeve. This draws the flange portion 15 into tight sealing engagement with a gasket 19 sandwiched between the bulkhead and the flange to achieve a liquid-sealed connection and support for the heating element.

Referring to FIG. 2, fitting 10 includes a central axially-extending aperture 21 dimensioned to receive sheath 14, preferably in a predetermined size relationship. As shown in FIG. 3, this aperture extends through both the radial portion 15 and the sleeve portion 16 of the fitting, being of slightly increased diameter in the sleeve portion. (In one particular embodiment a five to six thousandths of an inch with conventional tolerances was found adequate to allow easy assembly and yet still allow a watertight fit after assembly in accordance with the method of the invention to be presently described.) An annular shoulder 29 is formed where aperture 21 increases in diameter between the flange and sleeve portions of the fitting.

In accordance with the invention, a solderless liquid-tight rotationally-locked attachment is obtained between fitting 10 and the outer sheath 14 of heating element 11 by means of lip portion 22 on the face of flange portion 15, adjacently surrounding aperture 21. When fitting 10 is installed on heating element 11 portions of lip 22 are compressed axially with respect to aperture 21. As shown in FIG. 3, this causes a radially-inward deformation 23 of the wall of aperture 21 in sleeve portion 16, a corresponding radially-inward deformation of sheath 14 and an axially-downward and radially-inward deformation 24 of fitting 10 adjacent shoulder 29. These deformations, which result from cold flow of the malleable metals of the sheath and fitting, serve to form a mechanically-tight liquid sealing engagement between the fitting and the sheath.

In further accord with the invention, rotation of fitting 10 with respect to heating element 11 is prevented by providing two diametrically opposed circumferential portions 25 and 26 (FIGS. 1, 4 and 5) on the annular lip 22 of fitting 10 which are not axially compressed to the same extent as the rest of the lip. As shown in FIG. 4, this has the effect of causing a lesser radially-inward deformation 27 of the walls of aperture 21 and sheath 14, and a lesser axially-downward and radially-inward deformation 28 of fitting 10 adjacent shoulder 29. As a result, the wall of aperture 21 and sleeve 14, when viewed in cross section, as in FIG. 6, are out-of-round or oval. Consequently, the fitting and sleeve are effectively rotationally locked as well as being liquid sealed.

A method for installing fitting 10 onto the sheathed heating element 11 is illustrated in FIG. 7. The method utilizes a first die member 30 having a working surface 31 and a central aperture 32 of approximately the same diameter as aperture 21 in the flange portion 15 of fitting 10. As shown in FIG. 8, a pair of radially-outwardly extending channels 33 are provided at diametrically-opposed locations on working surface 31 about the circumference of aperture 32 for the purpose of forming the rotation-locking portions 25 and 26 of lip 22.

The method also utilizes a second die member 34 having an upwardly projecting hollow cylindrical working portion 35. The outer diameter of working portion 35 is approximately the same as the diameter of aperture 21 in sleeve portion 16 so that portion 35 is slidably received therein. Working portion 34 includes an aperture 36 having approximately the same diameter as aperture 21 in flange portion 15 for slidably receiving sheath 14, and a flat ring-shaped anvil surface 37 on its projecting end.

In installing fitting 10 on heating element 11, sheath 14 is inserted through aperture 32 in die member 30, through aperture 21 in fitting 10, and through aperture 36 in die member 34. Fitting 10 is next positioned on die member 34 with the hollow cylindrical working portion 35 of the die member extending into aperture 21 so that its anvil portion 37 abuts shoulder 29. At the same time the working surface 31 of die member 30 is brought into abutment with the top surface of lip portion 22. The two die members 30 and 34 are now axially compressed, causing lip portion 22, except where it abuts channels 33, to be compressed in an axial direction so as to form the radially-inward deformation 23 of the wall of aperture 21 and sheath 14 shown in FIG. 3. Since the opposed channels 33 in the working surface 31 of die member 30 prevent the underlying circumferential portions of lip 22 from being compressed to the same extent as adjacent portions which do not underlie the channels, the inward deformation 27 of the wall of aperture 21 is appreciably less at these locations, as shown in FIG. 4. As a result, the radial distortion of aperture 21 and sheath 14 brought about by die members 30 and 34 is oblong as shown in FIG. 6, and fitting 10 and heating element 11 are rotatably locked in liquid-sealed engagement.

The axial deformations 24 (FIG. 3) and 28 (FIG. 4) of the wall of aperture 21 occur as a result of anvil surface 37 pressing against shoulder 29 as lip 22 is compressed by die member 30. These deformations may be viewed as secondary deformations of fitting 10 and sheath 14 which assist the aforedescribed deformations 23 (FIG. 3) and 27 (FIG. 4) in achieving a mechanically-tight liquid seal.

The extent of the radial deformation of fitting 10 and sheath 14 is dependent to a large extent on the height of the raised lip portion 22 above the face of flange portion 15. In practice the height of lip 22 is such that a deformation results which is sufficient to obtain a mechanically-tight liquid seal, but not so large as to damage the insulating sleeve 13 of sheath 14 of heating element 11. The extent to which the deformation deviates from true round is controlled by the depth of channels 33. For maximum deviation from true round, which corresponds to a minimum deformation 27 in FIG. 4, the channels are formed to have a depth equal to or greater than the height of lip 22. For less deviation the channels are formed shallower to obtain a greater deformation 27. In practice the bottom surfaces of channels 33 may be inclined or chamfered to provide a radially outwardly-increasing partial axial compression of lip 22, the partially compressed lip forming rotation-locking portions 25 and 26 with smoothly rounded top surfaces corresponding to the chamfered bottom surfaces.

It will be appreciated that fitting 10 can be formed in various sizes for use with heating elements of various diameters. It will also be appreciated that lip portion 22, while shown as a ring-shaped element surrounding aperture 21, could be provided in other forms, such as in a discontinuous ring composed of arcuate sections, or in a square or hex-shaped configuration centered about aperture 21. Furthermore, while the fitting has been shown as having two opposed rotation-locking portions, it would be possible to provide a lesser or greater number of locking portions to suit other requirements. By reason of its ease of installation and avoidance of time-consuming soldering operations, the fitting of the invention is particularly well adapted for high-volume production operations wherein an economical mechanically-rigid liquid seal for a rod-type heating element or other sheathed electrical conductor capable of withstanding repeated loosening and tightening operations is required.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

For example, the fitting may be attached by the described method to an unfilled portion of the sheath or to an empty sheath. Also, although a circular cross-sectional sheath is preferred, the invention, in at least its broader aspects, could also be employed with non-circular shaped sheaths.

I claim:

1. An electric heating element assembly for mounting through an aperture in a bulkhead, said assembly comprising, in combination:

a sheathed electrical heating element, a fitting including a radial flange portion having a diameter greater than said bulkhead aperture, a sleeve portion integrally adjacent and concentric with said flange portion and having an outer diameter smaller than said bulkhead aperture and a length greater than the thickness of said bulkhead, fastener receiving means on said sleeve portion for engaging a fastener for drawing said flange portion into engagement with the bulkhead, said flange and sleeve portions including an axially-extending aperture through which said sheathed heating element is extended, and a circumferential portion of the wall of said axially-extending aperture being deformed out-of-round to decrease the cross-sectional area of said aperture and establish a solderless mechanically-rigid locked-rotation liquid-seal with the sheath of said heating element.

2. A heating element assembly as defined in claim 1 wherein said fitting includes lip means on the surface of said flange portion for deforming said circumferential portion of said wall of said axially-extending aperture in response to an externally-applied axial compression force.

3. A heating element assembly as defined in claim 2 wherein said lip means include a lip on the face of said flange portion, a circumferential portion of said lip being axially compressed into the face of said flange so as to force a portion of said flange portion adjacent said lip portion to protrude axially into said axially-extending aperture.

4. A heating element assembly a defined in claim 3 wherein said lip surrounds and is adjacent to said axially-extending aperture.

5. An electric heating element as defined in claim 1 wherein said aperture includes a first portion, and a second die-receiving portion adjacent said first portion of larger diameter than said first portion, and wherein the wall of said aperture is deformed at a first location in said first portion, and at a second location in said first portion axially spaced from said first location and adjacent said second portion.

6. An electric heating element as defined in claim 5 wherein said first location is adjacent the outside surface of said flange portion.

7. An electric heating element as defined in claim 5 wherein said first portion is within said flange portion and said second portion is within said sleeve portion.

8. An electric heating element assembly for mounting through an aperture in a bulkhead, said assembly comprising, in combination:

a sheathed electrical heating element;

a fitting including a radial flange portion having a diameter greater than said bulkhead aperture, and a sleeve portion integrally adjacent and concentric with said flange portion and having an outer diameter smaller than said bulkhead aperture and a length greater than the thickness of said bulkhead, fastener receiving means on said sleeve portion for engaging a fastener for drawing said flange portion into engagement with said bulkhead, said flange and sleeve portions including an axially-extending aperture through which said sheathed heating element is extended, and a deformable lip on the face of said flange portion surrounding and adjacent to said axially-extending aperture, at least a portion of said lip being axially compressed to deform the wall of said axially-extending aperture to establish a solderless mechanically-rigid liquid-sealing engagement between said fitting and the sheath of said heating element.

9. A fitting for securing a sheathed electric heating element through an aperture in a bulkhead, said fitting comprising:

a radial flange portion having a diameter greater than said bulkhead aperture;

a sleeve portion integrally adjacent and concentric with said flange portion and having an outer diameter smaller than said bulkhead aperture and a length greater than the thickness of said bulkhead;

fastener receiving means on said sleeve portion for engaging a fastener for drawing said flange portion into engagement with the bulkhead;

said flange and sleeve portions including an axially-extending aperture dimensioned to slidably receive the sheath of the heating element; and lip means on the surface of said flange portion for deforming at least a portion of the wall of said axially-extending aperture in response to an externally-applied compressive force to decrease the cross-sectional area of at least a portion of said aperture so as to establish a solderless mechanically-rigid liquid-seal with the sheath of the heating element.

10. A fitting as defined in claim 9 wherein said lip means include a lip on the face of said flange portion, said lip being axially compressible into the face of said flange so as to force at least a portion of said flange portion adjacent said lip to protrude radially into and decrease the cross-sectional area of said axially-extending aperture.

11. A fitting as defined in claim 10 wherein said lip extends around only a portion of said axially-extending aperture so as to force an out-of-round deformation of the walls of said aperture to establish a fixed-rotational relation between said fitting and said sheath.

12. A fitting as defined in claim 9 wherein said aperture includes a first portion, and a second die-receiving portion adjacent said first portion of larger diameter than said first portion, whereby the wall of said aperture may be deformed at a first location in said first portion adjacent the outside surface of said flange portion, and at a second location in said first portion adjacent said second portion.

13. A fitting as defined in claim 12 wherein said first portion is within said flange portion and said second portion is within said sleeve portion.

14. An electric heating element assembly for mounting through an aperture in a bulkhead, said assembly comprising, in combination:

a sheathed electrical heating element, a fitting including a radial flange portion having a diameter greater than said bulkhead aperture, a sleeve portion integrally adjacent and concentric with said flange portion and having an outer diameter smaller than said bulkhead aperture and a length greater than the thickness of said bulkhead, a fastener receiving means on said sleeve portion for engaging a fastener for drawing said flange portion into engagement with the bulkhead, said flange and sleeve portions including an axially-extending aperture through which said sheathed heating element is extended, said aperture including a first portion, and a second die-receiving portion adjacent said first portion of larger diameter than said first portion; and the wall of said axially-extending aperture being deformed at a first location in said first portion, and at a second location in said first portion axially spaced from said first location and adjacent said second portion, to decrease the cross-sectional area of said aperture at said locations to establish a solderless mechanically rigid seal with the sheath of said heating element.

15. An electric heating element as defined in claim 14 wherein said first location is adjacent the outside surface of said flange portion.

16. An electric heating element as defined in claim 14 wherein said first portion is within said flange portion and said second portion is within said sleeve portion.

17. A fitting for securing a sheathed electric heating element through an aperture in a bulkhead, said fitting comprising:

a radial flange portion having a diameter greater than said bulkhead aperture;

a sleeve portion integrally adjacent and concentric with said flange portion and having an outer diameter smaller than said bulkhead aperture and a length greater than the thickness of said bulkhead;

fastener receiving means on said sleeve portion for engaging a fastener for drawing said flange portion into engagement with the bulkhead;

said flange and sleeve portions including an axially-extending aperture for slidably receiving the sheath of the heating element, said aperture including a first portion, and a second die-receiving portion adjacent said first portion of larger diameter than said first portion, whereby the wall of said axially-extending aperture may be deformed at a first location in said first portion, and a second location axially-spaced from said first location in said first portion adjacent said second portion to establish a solderless mechanically rigid seal with the sheath of the heating element.

18. A fitting as defined in claim 17 wherein said first portion is within said flange portion and said second portion is within said sleeve portion.

* * * * *